United States Patent [19]

Watanabe

[11] Patent Number: 4,600,293

[45] Date of Patent: Jul. 15, 1986

[54] PHOTOCOPYING APPARATUS AND METHOD WHEREIN THE OPTICAL SCANNER ACTS AS AN ALIGNMENT GUIDE

[75] Inventor: Junji Watanabe, Yokohama, Japan

[73] Assignee: Tokyo Shibaura Denki Kabushiki Kaisha, Kawasaki, Japan

[21] Appl. No.: 595,356

[22] Filed: Mar. 30, 1984

[30] Foreign Application Priority Data

Mar. 30, 1983 [JP] Japan ..... 58-54306
Mar. 30, 1983 [JP] Japan ..... 58-54307

[51] Int. Cl.[4] ..... G03G 15/28
[52] U.S. Cl. ..... 355/8; 355/14 E
[58] Field of Search ..... 355/14 E, 55, 46, 14 ER, 355/75, 7, 8, 40

[56] References Cited

U.S. PATENT DOCUMENTS 3,877,809 4/1975 Suzuki et al. ..... 355/133
4,260,248 4/1981 Murata et al. ..... 355/75

FOREIGN PATENT DOCUMENTS 3411969 3/1984 Fed. Rep. of Germany .

*Primary Examiner*—A. T. Grimley
*Assistant Examiner*—David Warren
*Attorney, Agent, or Firm*—Cushman, Darby & Cushman

[57] ABSTRACT

A copy machine includes a document table on which a document is placed aligning at the left end with the left end of the document table, and a lamp, under the document table, which scans from left to right for a distance corresonding to the width of a designated copy sheet. Before the start of the copying operation, a carriage for supporting the lamp is located at a position distanced from the left end of the document table by a length corresponding to the width of the copy sheet. A display is provided on the upper surface of the carriage. Before the copying operation starts, the display emits light to indicate a copy allowable range.

12 Claims, 20 Drawing Figures

PHOTOCOPYING APPARATUS AND METHOD WHEREIN THE OPTICAL SCANNER ACTS AS AN ALIGNMENT GUIDE

BACKGROUND OF THE INVENTION

The present invention relates to a copy machine and method capable of copying documents of many different sizes.

In the prior copy machine, the exposure lamp scans the document table from right to left. Because of this, the document or original is set on the document table with the left end thereof aligned with the corresponding end of the document table. The scanning distance of the exposure lamp is selected to be equal to the width of the designated copy sheet. Structurally, cassettes of various sizes, containing copy sheets of the corresponding sizes, can be loaded in the copy machine to make copies of different sizes. Before entering the copying operation, the desired copy size or cassette size is designated by pushing the appropriate button, for example. Then, a symbol representing the size of the copy sheet, for example, A4 or B5, is displayed on the operation panel. A scale marked with copy size characters A4 and B5, for example, is mounted at the appropriate peripheral portion of the document table. The copy machine can not indicate whether the size of the copy sheet actually set is correct or not. For this reason, if the document is partially off the scanning range of the exposure lamp, the entire document will not be copied.

SUMMARY OF THE INVENTION

Accordingly, an object of the present invention is to provide a copy machine and method which can indicate on a document table a copy range corresponding to the size of a designated copy sheet.

To achieve the above object, there is provided a copy machine comprising: means for designating a size of a copy sheet; a document table on which a document is arranged aligning at one side with one side of the document; optical means under the document table for moving, from the one side of the document table the distance corresponding to the size of a designated copy sheet thereby optically scanning the document; image formation means for forming an image of the document on the copy sheet having a designated size according to light reflected from the document, which is exposed to the light emitted from the optical means; and means for displaying a copy allowable range, the display means being provided in the document table at a position corresponding to the size of a designated copy sheet and separated from the one side thereof.

DETAILED DESCRIPTION OF THE PREFERRED EMBODIMENTS

Figure 1:
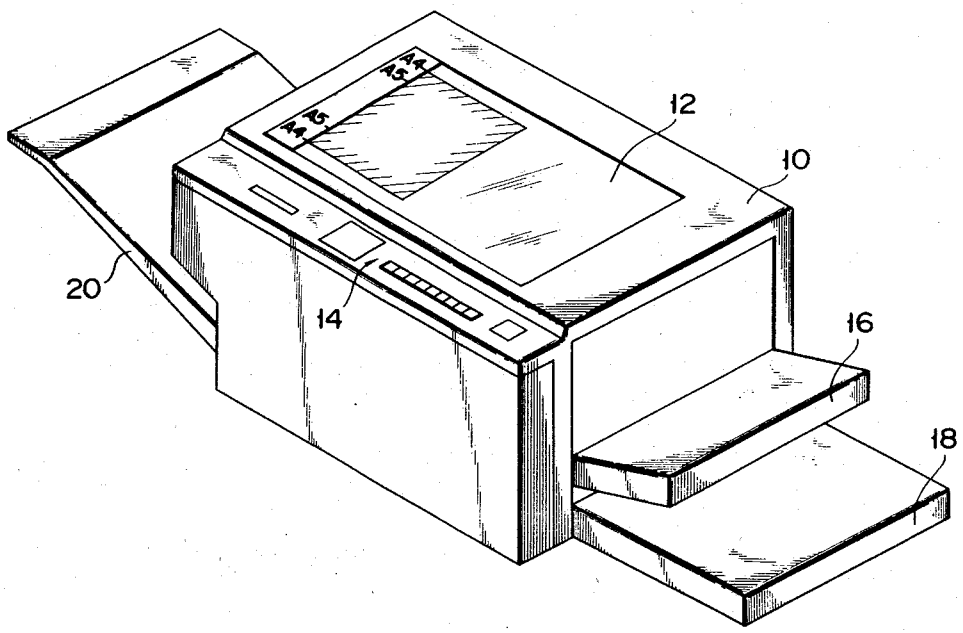
FIG. 1 is a perspective view illustrating the outer appearance of a first embodiment of a copy machine according to the present invention.

A first embodiment of a copy machine according to the present invention will be described referring to FIGS. 1 to 16. FIG. 1 illustrates the outer appearance of the copy machine of the first embodiment. As shown, a main frame 10 has on the upper surface a document table 12 formed of transparent glass, and an operation panel 14 with various kinds of keys for designating the desired copy size, the number of copies, the desired copy mode, etc. In this copy machine, two paper cassettes 16 and 18, upper and lower, for copying documents of different sizes are loaded into the right end (as viewed in the drawing) of the main frame 10. A document having any size is set vertically on the document table 12. That is, it is aligned so that the left side of the document is aligned with the left side of the document table 12. Each cassette also contains a bundle of copy sheets. The copy of the document is discharged from the left side of the main frame 10 and accumulated on a tray 20.

Figure 2:
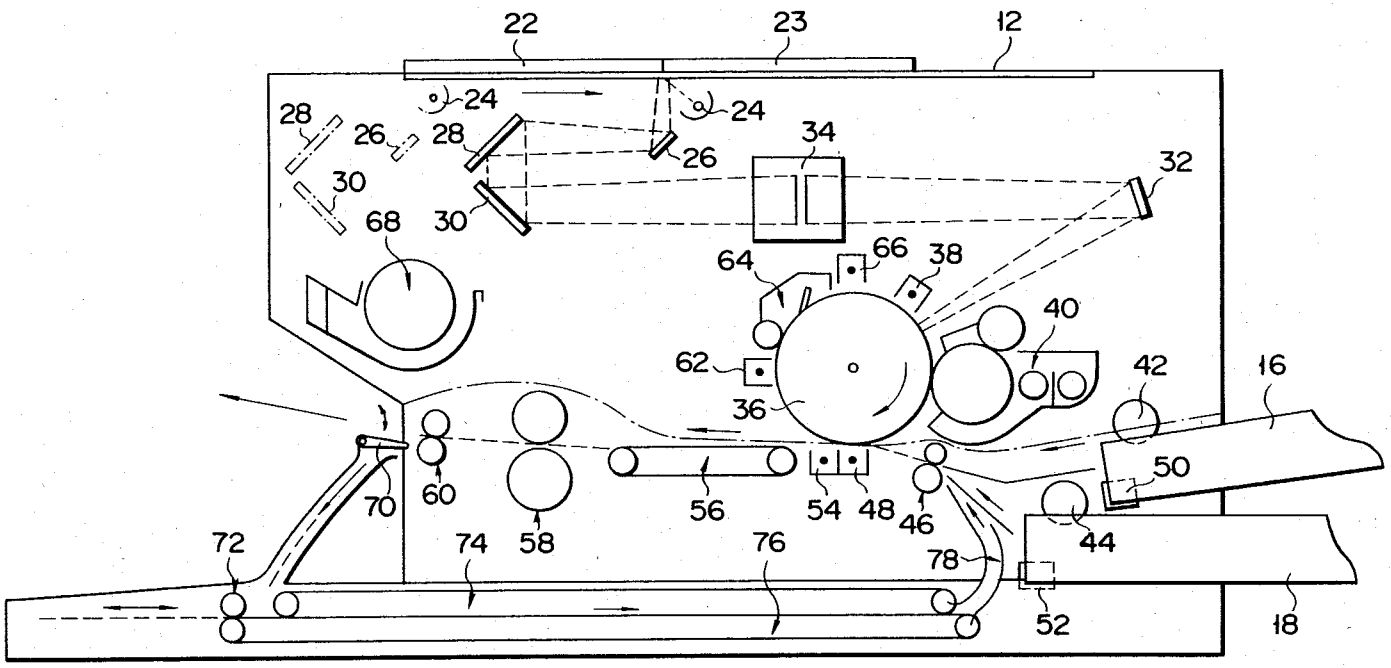
FIG. 2 schematically illustrates a cross section of the first embodiment.
Figure 3:
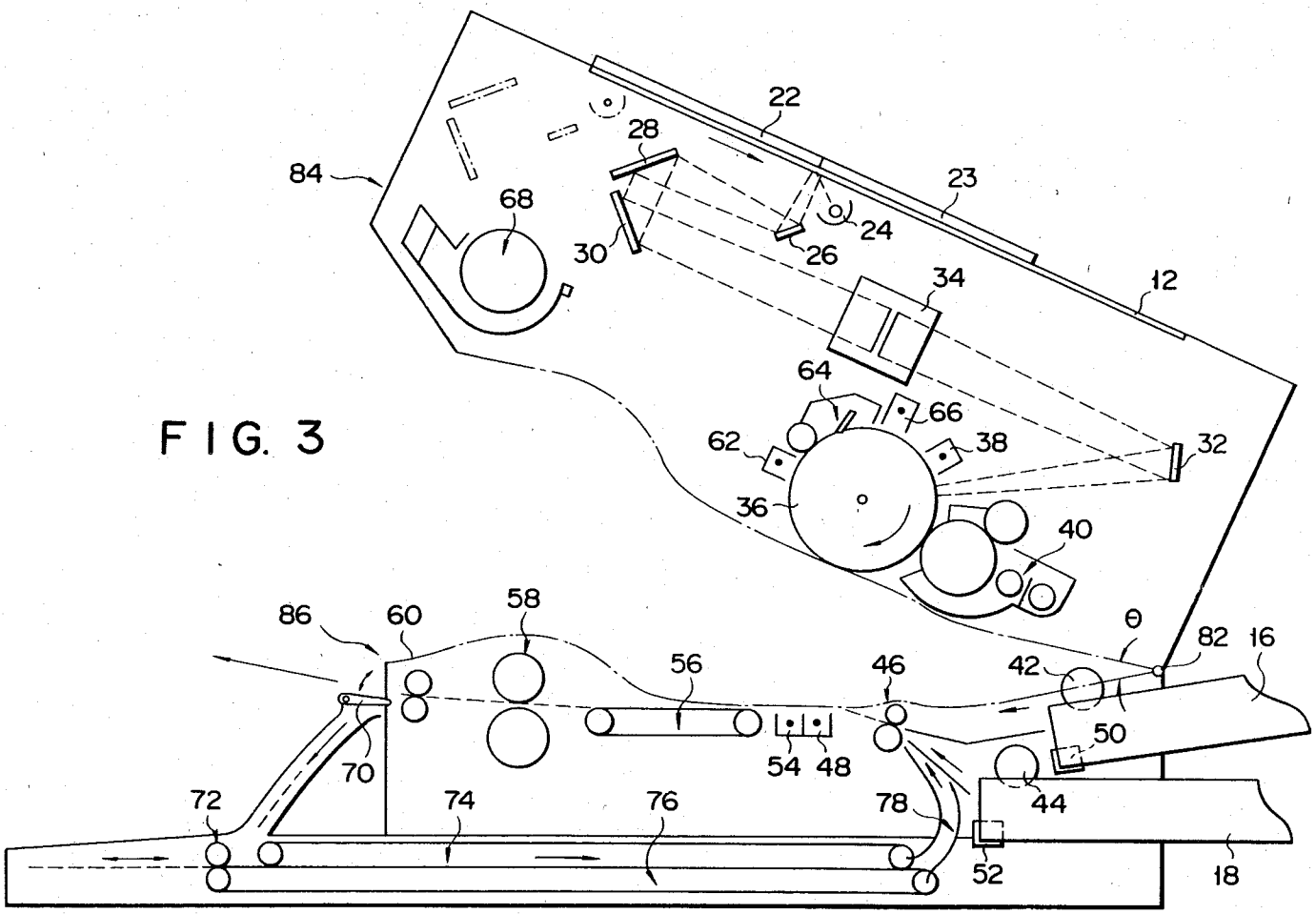
FIG. 3 schematically illustrates a cross section of the first embodiment when the upper unit is raised.

FIG. 2 is the schematic illustration of the structure of the present embodiment. Documents 22 and 23 which are arranged on the document table 12 are illuminated by an optical system containing an exposure lamp 24 and mirrors 26, 28 and 30 when the optical system moves in the direction of the arrow. The home position (stand-by position) of the optical system is at the illumination or exposure end point as indicated by the solid line, not at the left end of the document, i.e., the illumination starting point. The reasons for this will be given later. When the exposure lamp 24 and the mirror 26 move at speed V, the mirrors 28 and 30 move at speed $\frac{1}{2}$ V. The reason why the moving speeds of those components are so set is that the length of the optical path from the document 22 via the mirrors 26, 28 and 30 to a fixed mirror 32 is kept constant so that the size of the document will be the same as that of the copy image, i.e., when the copy magnification is set at "1". A magnification changing lens block 34 is interposed between the mirror 30 and the fixed mirror 32 to reduce the copy from a B4 size to an A4, for example, or to enlarge copy from an A4 size to a B4 size. The reflecting light from the document 22 is reflected by the fixed mirror 32, and led to the photosensitive drum 36. At this time, the photosensitive drum 36 is exposed to a slit light. The photosensitive drum 36 is rotated in the direction of the arrow which is synchronized with the scanning operation of the optical system. The photosensitive drum 36 is charged with a positive charge by a charger 38. Then, the photosensitive drum 36 is illuminated with light reflected from the document 22 to create an electrostatic latent image of the document on the surface thereof. The electrostatic latent image is applied with toner which is negatively charged by a developer 40 to become visualized. Then, either the upper cassette 16 or the lower cassette 18 is selected and the copy sheets contained therein are taken out sheet-by-sheet by means of a roller 42 (or 44). Each sheet is directed to a pair of aligning rollers 46 which rotate together with the photosensitive drum 36 at a predetermined timing, thereby feeding each sheet between the transfer device 48 and the photosensitive drum 36. The cassettes 16 and 18 are removably inserted into the right lower portion of the main frame 1. Cassette size sensors 50 and 52 are provided in the insertion holes for the cassettes 16 and 18. The cassette size sensors 50 and 52 each contain a plurality of microswitches which are turned on and off in response to the size of the inserted cassette.

The copy sheet fed from the aligning roller pair 46 is in contact with the photosensitive drum 36. Under this contact, the transfer device 48 applies positive charges to the copy sheet, and the toner image is transferred from the photosensitive drum 36 onto the copy sheet. The copy sheet with the transferred toner image is then separated from the photosensitive drum 36 by a separator 54, and is transferred to a pair of fixing rollers 58 by a transfer belt 56. The fixing roller pair 58 applies heat and pressure to the copy sheet, thereby fixing the toner image. After fixing, the copy is discharged to the outside of the main frame by a pair of discharge rollers 60.

The photosensitive drum 36, after it is subjected to the toner transfer process, reaches a charge remover 62. The charge remover 62 removes charges on the photosensitive drum 36. Further, the residual toner on the surface of the drum 36 is removed by a cleaner 64. Further, an afterimage (residual charges) is erased by a discharge lamp 46. At this point, the drum 36 is returned to its initial state.

To prevent an excessive temperature rise in the main frame, a cooling fan 68 is provided near the discharge roller pair 60.

The present embodiment is so designed that after one side of the copy sheet is copied, the copy sheet is reversed and returned to the aligning roller pair 46 to copy the image on the reverse side of the copy sheet. To be more specific, a gate 70 is provided on the outside of the discharge roller pair 60. In a both-side copy mode, the gate 70 is operated to allow the copy sheet emanating from the discharge roller pair 60 to be transferred to the left (as viewed in the drawing) by the inverting roller pair 72. Then, the rotation of the inverting roller pair 72 is inverted and the copy sheet is transferred to the right side, i.e., to the cassette side, through the lower portion of the main frame, while being nipped by transfer belts 74 and 76. The copy sheet released from the transfer belts 74 and 76 is inverted by an inverting path 78, and is transferred again into the aligning roller pair 46.

A copy machine thus arranged is divided into two units, upper and lower units 64 and 86, along the copy sheet transfer path as indicated by the dotted line in FIG. 2. The copy machine is opened by raising the upper unit 84 to form an angle $\theta$ with the lower unit 36. When jam trouble occurs during the transfer of the copy sheet, the upper unit 84 is opened to allow the removal of the jammed sheet. As described above, the home position of the optical system is not in the left end, but in the center portion of the main frame, i.e., the portion closer to a shaft 82 joining the upper and lower units 84 and 86. Therefore, a less moment is required to open the upper unit 84.

Figure 4:
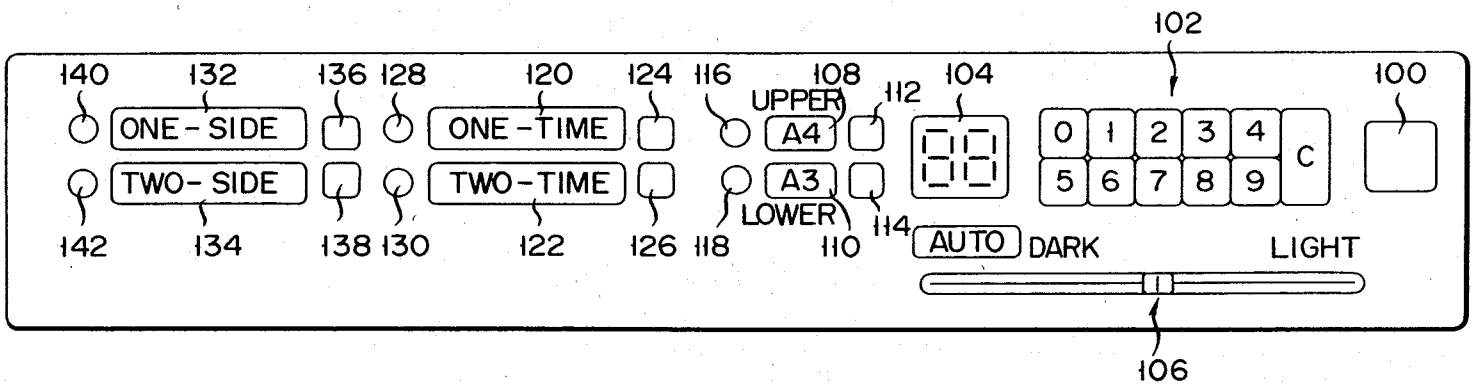
FIG. 4 shows a plan view of an operation panel of the embodiment of FIG. 1.

A plan view of the operation panel 14 provided on the upper surface of the main frame of the copy machine is illustrated in FIG. 4. As shown, a start key 100 for starting the copying operation, a plurality of ten keys 102 for setting a desired number of copies, a display 104 for displaying the number of copies, and a gray level setter 106 for setting the gray level of the copy image, are arranged from right to left in the drawing. The sizes of the upper and lower cassettes are respectively displayed by displays 108 and 110. Select keys 112 and 114 are disposed on the right side of the displays 108 and 110. LEDs 116 and 118 showing the selection of the cassettes are provided on the left side of the displays 108 and 110. Scanning mode displays 120 and 122 are provided to select either a one-time scanning mode or a two-time scanning mode. Select keys 124 and 126 are provided on the right sides of the displays 120 and 222. LEDs 128 and 130 are provided on the left side to displays the selection made by the select keys. Displays 132 and 134 display a single-side copy and a double-side copy, respectively. Select keys 136 and 138 are provided on the right side of displays 132 and 134. LEDs 140 and 142 are located to the left of those keys to display the selection made by the select keys 136 and 138.

Figure 5:
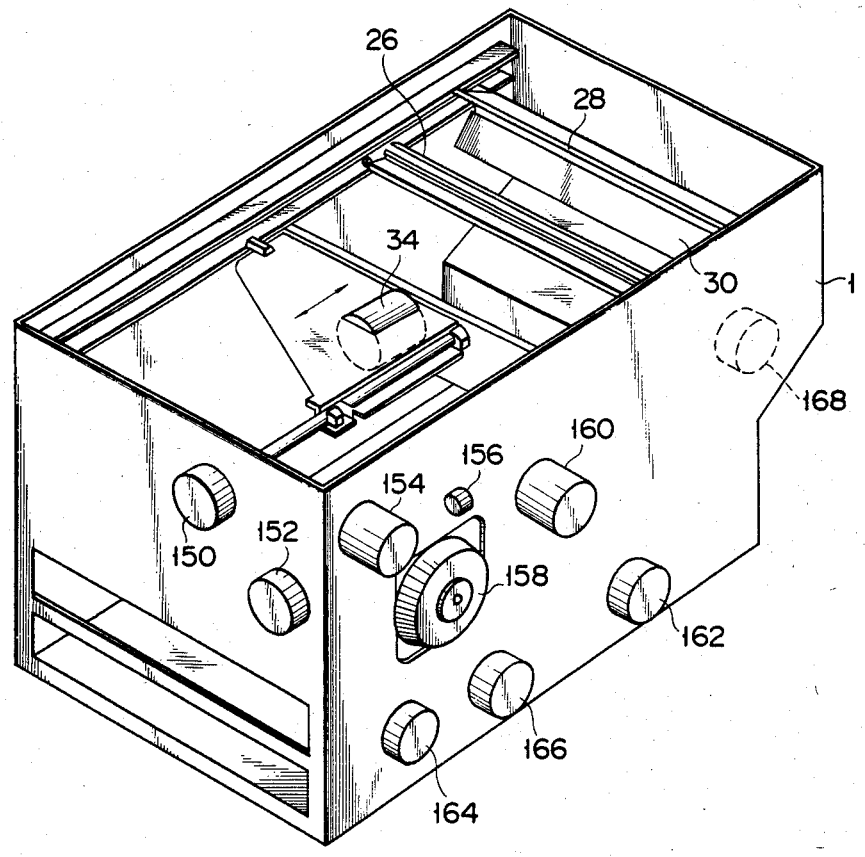
FIG. 5 is a perspective view illustrating how pulse motors as drive sources in the embodiment are allocated.

FIG. 5 shows an allocation of drive sources which are made of pulse motors. The drawing of FIG. 5 is depicted as if viewed from the rear side of the copy machine, although the FIG. 1 drawing shows the front side of the copy machine. A magnification changing motor 150 is provided for changing the location of the magnification changing lens block 34. The motor 152 changes the distance (optical path) between the mirror 26 and the mirror 28 when the copy magnification is changed. A scanning motor 154 moves the exposure lamp 24 and the mirrors 26, 28 and 30 for scanning the document. A shutter motor 156 moves the shutter (not shown) to adjust the charging width of the charge on the photosensitive drum 36 which is formed by the charger 38 when the copy magnification is changed. A developing motor 158 drives the developing roller of the developer 40. A drum motor 160 drives the photosensitive drum 36. A fixing motor 162 drives the transfer belt 56, the fixing roller pair 58, and the discharge roller pair 60. A paper feed motor 164 drives the feed rollers 42 and 44. A paper feed motor 166 drives the aligning roller pair 46. A fan motor 168 drives a cooling fan 68.

Figure 6:
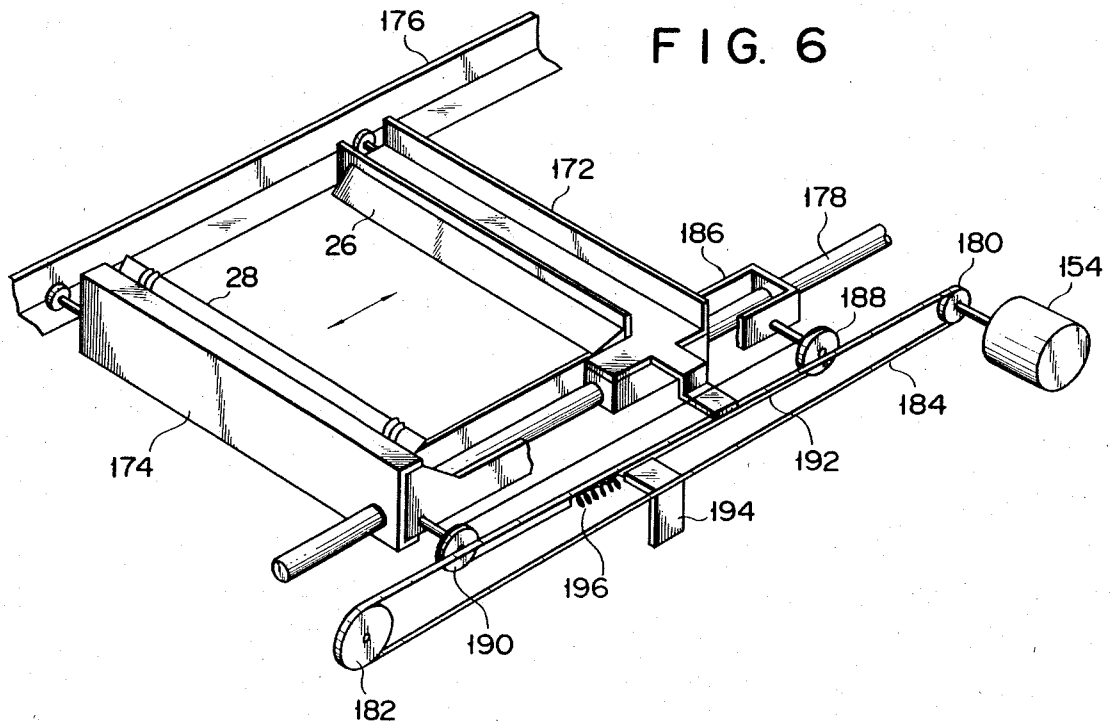
FIG. 6 is a perspective view of a scanning mechanism for moving an optical system in the embodiment.

FIG. 6 shows a scanning mechanism for moving the optical system comprised of the exposure lamp 24 and the mirrors 26, 28 and 30 along the document table. The mirror 26 and exposure lamp 24 are supported by a first carriage 172; the mirrors 28 and 30 are supported by a second carriage 174. These carriages 172 and 174 can move in the direction of the arrow along with the guide rails 176 and 178. The scanning motor 154 has a 4-phase pulse motor which drives a pulley 180. An endless belt 184 is wound around this pulley 180 and an idle pulley 182. The first carriage 172 supporting the mirror 26 is fixed at one end to the mid portion of the endless belt 184. A couple of rotatable pulleys 188 and 190 are mounted to the guide 186 of the second carriage 174. The pulleys 188 and 190 are covered with a wire 192. One end of the wire 192 is fixed to a fixing piece 194, while the other end is fixed to the fixing piece 194 via a coiled spring 196. One end of the first carriage 172 is fixed to the mid-portion of the wire 192. With the rotation of the pulse motor 154, the belt 184 rotates causing the first carriage 172 to move. In turn, the second carriage 174 also moves. At this time, the pulleys 188 and 190 serve as a fall block. Therefore, the second carriage 174 moves at half of the speed of the first carriage 172 while traveling in the same direction as the first carriage 172. The moving direction of the first and second carriages 172 and 174 can be changed by reversing the rotating direction of the pulse motor 154.

When the copy size has been selected (specifically, from either of the upper cassette 16 or the lower cassette 18), the first carriage 172 is located at a position equal to the width of the copy sheet (its length is in the scanning direction) from the left end of the document table 12 (the opposite end of the cassette). This position is the home position of the first carriage 172. At this time, the second carriage is located on the left side of the first carriage 172.

Figure 7:
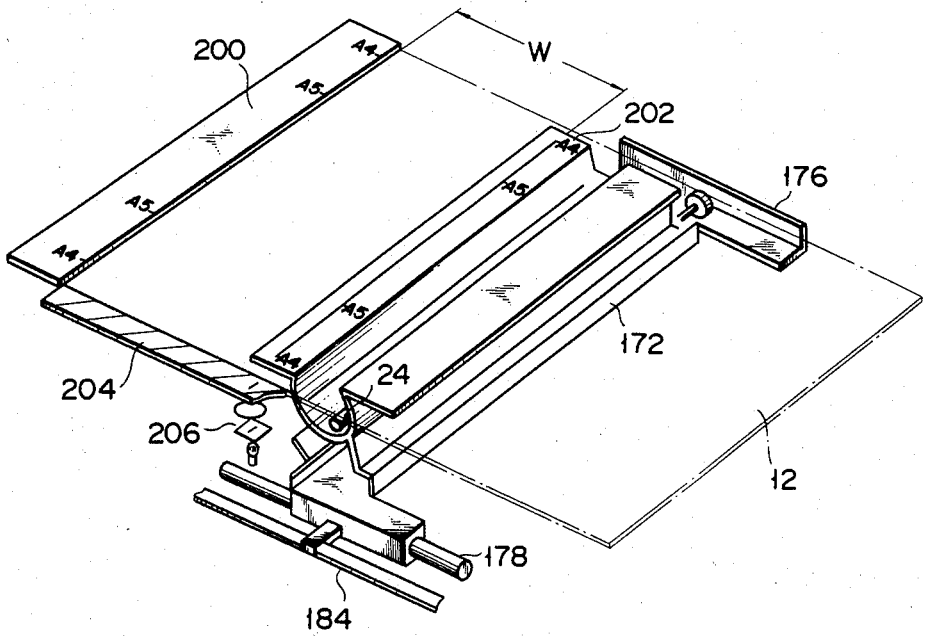
FIG. 7 is a perspective view of a document table capable of displaying a copy allowable range.
Figure 8:
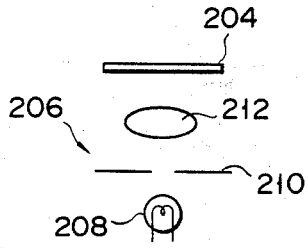
FIG. 8 is a cross-sectional view of an auxiliary display section used for the copy allowable range display.

The position of the first carriage 172 when a copy sheet of the A4 size is selected, is shown in FIG. 7. Each document is vertically set on the document table 12. Provided on the left end of the document table 12 is a scale 200 indicating the length of various copy allowable ranges. The first carriage 172 is also provided with a scale 202 indicating the length of the copy allowable range. As shown, each of the scales 200 and 202 is marked with A4 and A5 indicating the upper and lower limits of the copy allowable ranges. The part 204 of the document table 12 which is outside the copy area of the table, is made of frosted glass. The first carriage 172 has an auxiliary display 206 at a portion corresponding to the frosted glass portion. The auxiliary display 206 lights up from the instant the copy size is designated until the copy scanning is started. In this way, the copy allowable width is displayed on the frosted glass portion 204. Therefore, it is clearly detected whether the document is correctly arranged or not, thus preventing an incomplete copy. The auxiliary display section 206 comprises a light source 208, a slit 210 and a lens 212, as shown in FIG. 8.

Figure 9:
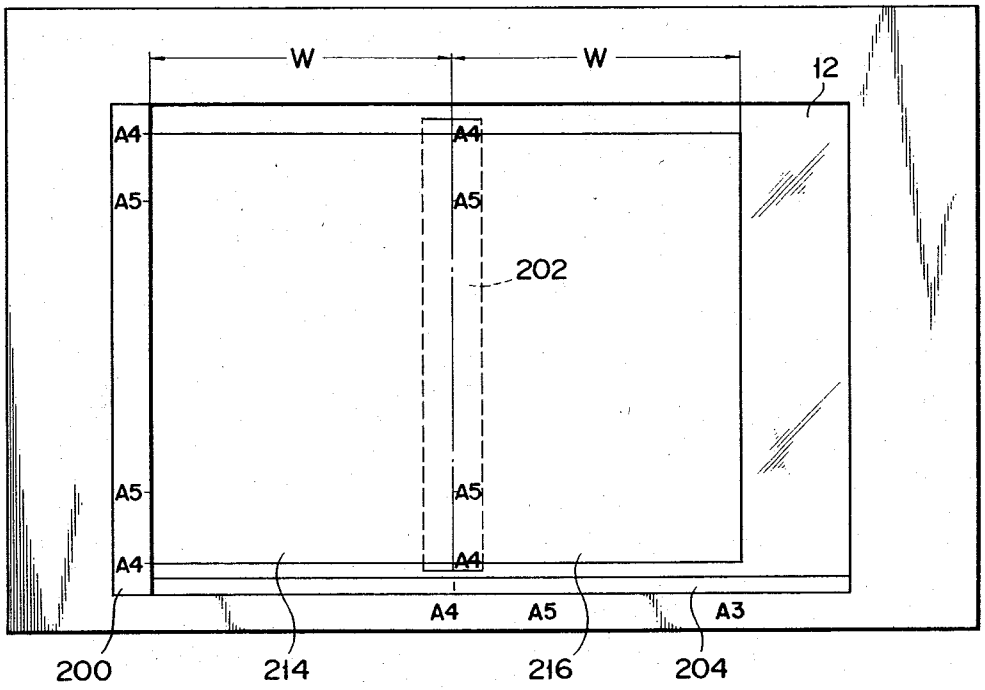
FIG. 9 is a plan view of a document table on which two documents are arranged.

FIG. 9 is a plan view of the section corresponding to the structure shown in FIG. 7. In this illustration, two documents 214 and 216 of an A4 size are placed side by side on the document table 12 for the two-time scanning mode to be given later.

Figure 10:
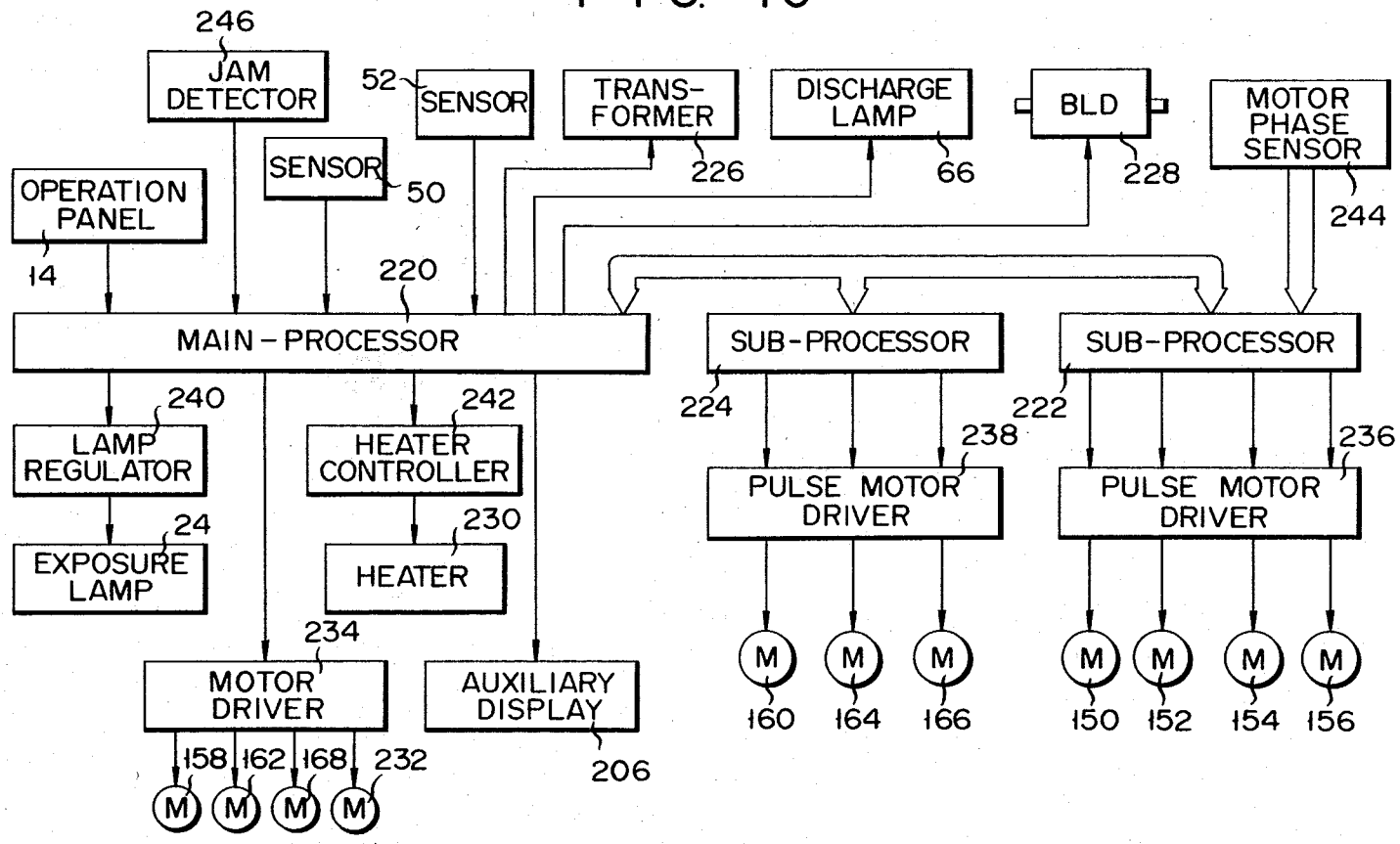
FIG. 10 is a block diagram illustrating the overall control system for the embodiment.

Turning now to FIG. 10, there is illustrated the overall control system of the present embodiment. As shown, the control system comprises a main processor 220, and first and second sub-processors 222 and 224. The main processor 220 detects signals from the operation panel 14 and the cassette size sensors 50 and 52, and controls a high voltage transformer 226, the discharge lamp 66, a blade solenoid (BLD) 228 of the cleaner 64, a heater 230 of the fixing roller pair 58, the exposure lamp 24 and the motors 150 to 168. Of those motors 150 to 168, the motors 158, 162 and 168 and a motor 232 for supplying toner to the developer 40 are controlled by the main processor 220 through a motor driver 234. The motors 150, 152, 154 and 156 are controlled by the first sub-processor 222 through a pulse motor driver 236, and the motors 160, 164 and 166 are controlled by the second sub-process 224 through a pulse motor driver 238. The exposure lamp 24 is controlled by the main processor 220 through a lamp regulator 240. A heater 230 is controlled by the main processor 220 through a heater controller 242. The main processor 220 sends motor drive and stop commands to the first and second sub-processors 222 and 224. These sub-processors 222 and 224 send status signals representing the drive and stop of the motors to the main processor 220. The main processor 220 is also connected to a jam detector 246 on the transfer path. The first sub-processor 222 is supplied with position data from a motor phase sensor 244 for detecting the initial position of each of the motors 150, 152, 154, and 156.

Figure 11:
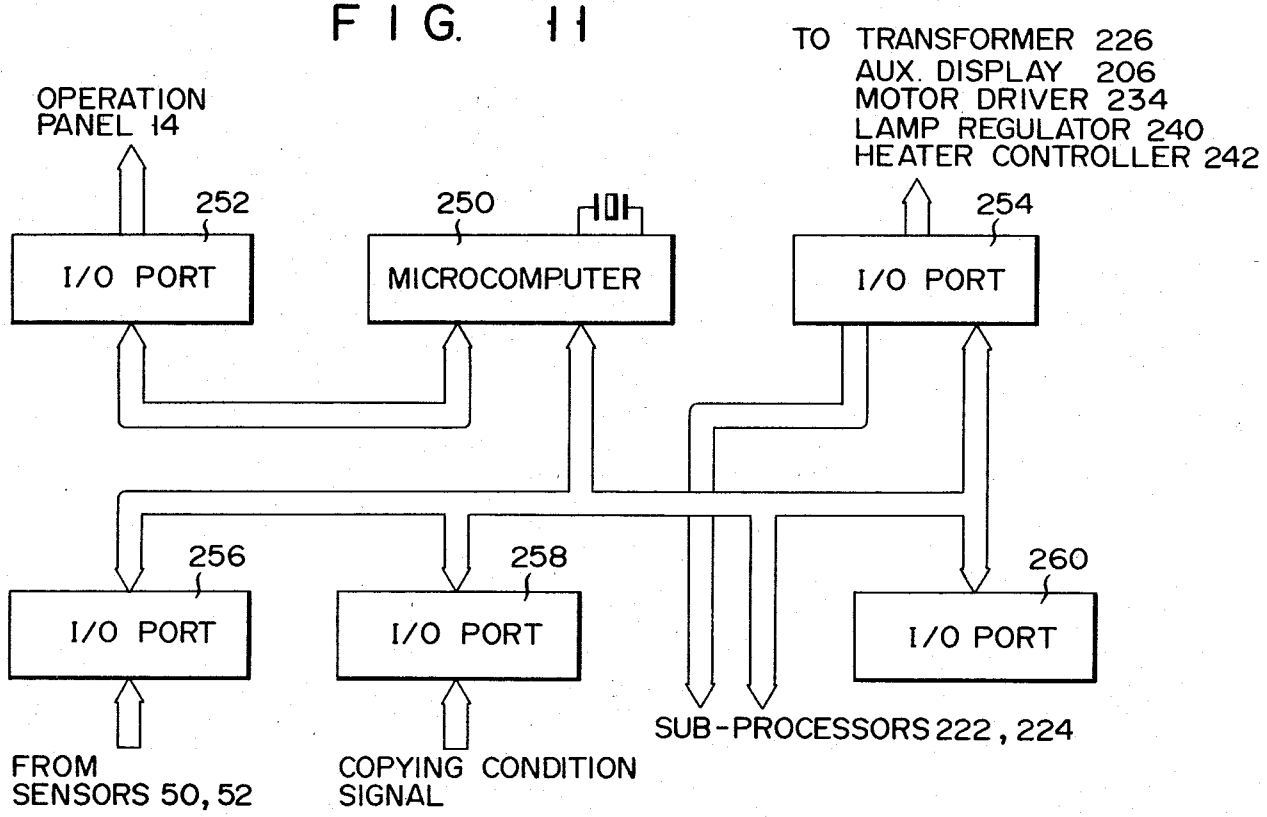
FIGS. 11 to 13 are respectively block diagrams showing a main processor, a first sub-processor, and a second sub-processor which are in the circuit of FIG. 10.

FIG. 11 shows an arrangement of the main processor 220. A microcomputer 250 detects key-in signals from the operation panel 14 through an I/O port 252, and controls various displays. The microcomputer 250 is provided with I/O ports 254, 256, 258 and 260. The I/O port 254 is coupled with the transformer 226, the auxiliary display 206 the motor driver 234, the lamp regulator 240, and with the heater controller 242. The I/O port 256 is coupled with the cassette size sensors 50 and 52, and the I/O port 258 receives the copy condition set signal. The I/O port 260 is optionally used.

Figure 12:
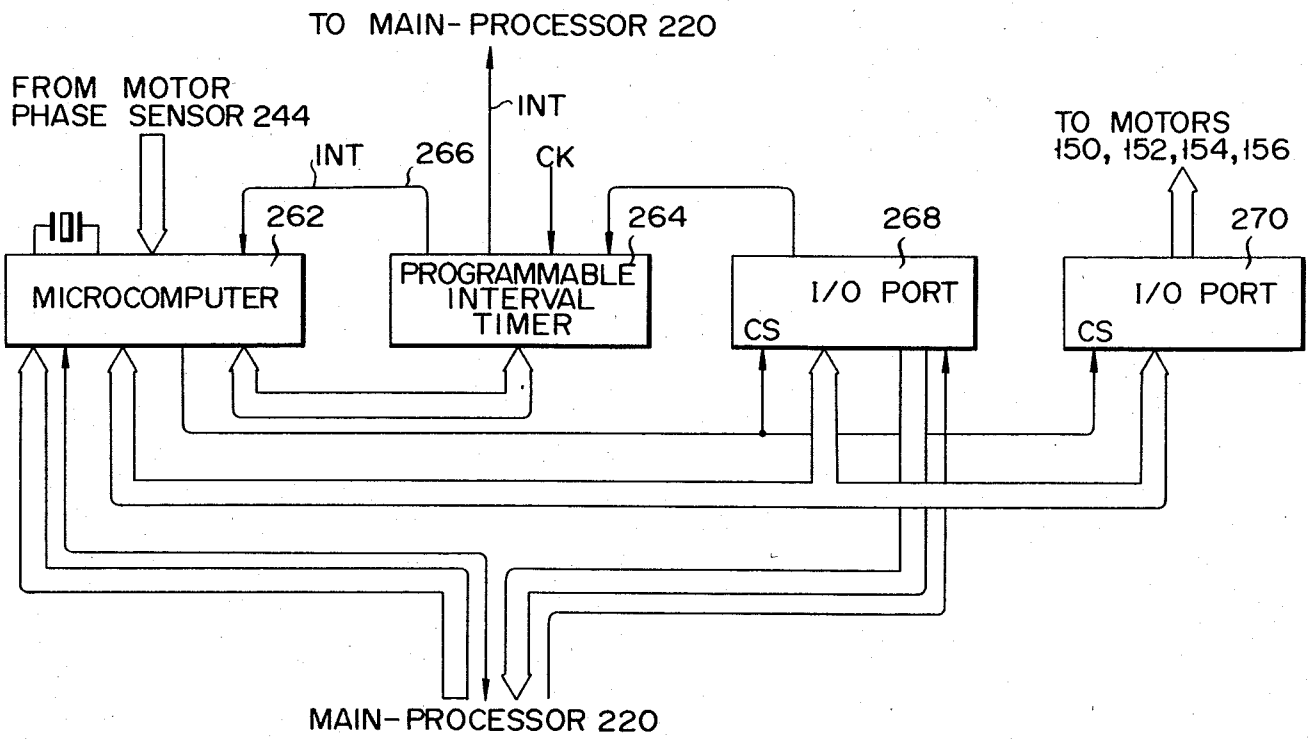

FIG. 12 shows a schematic illustration of the first sub-processor 222. A microcomputer 262 is connected to the main processor 220. A programmable interval time 264 is provided to control the phase switching of the pulse motor. The microcomputer 262 sets a set value of the programmable interval time 264. Then, the programmable interval timer 264 starts the counting operation and produces an end pulse to the interrupt line 266 of the microprocessor 262 when the count value reaches the set value. A reference clock pulse CK is input to the programmable interval timer 264. The microcomputer 262 receives the position data from the motor phase sensor 244 and is connected to the I/O ports 268 and 270. The motors 150, 152, 154, and 156 are connected through the pulse motor driver 236 to the I/O port 270. The I/O port 268 outputs the status signal of each pulse motor to the main processor 220.

Figure 13:
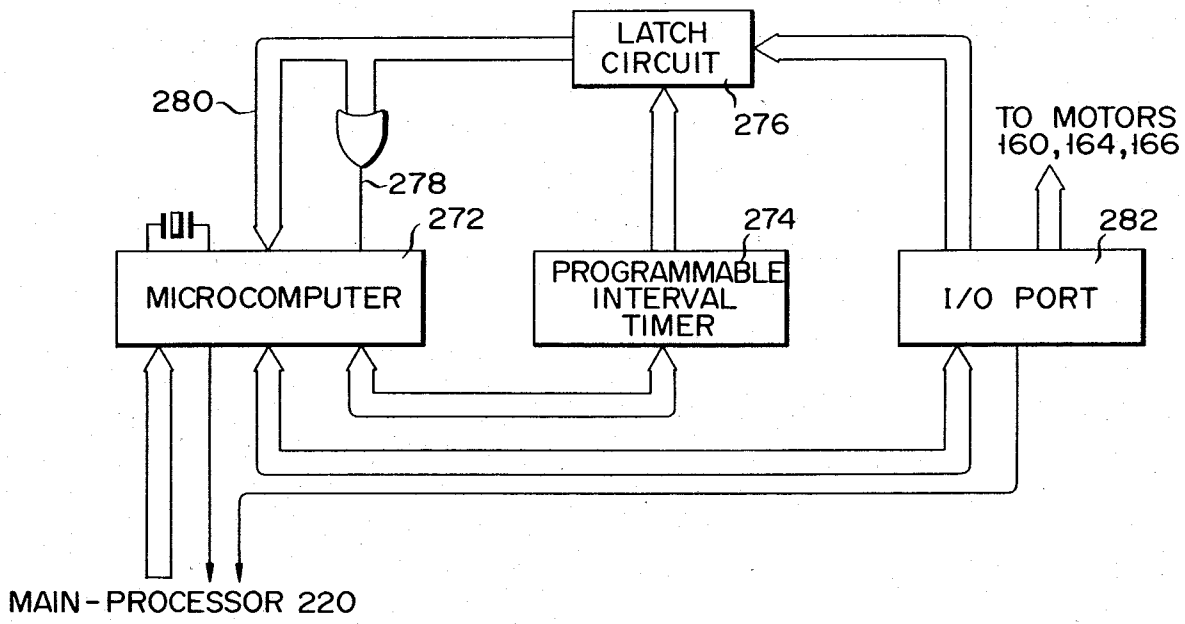

The arrangement of the second sub-processor 224 is shown in FIG. 13. A microcomputer 272 is connected to the main processor 220. A programmable interval timer 274 controls the time intervals for phase switching of the pulse motor. The microcomputer 272 sets a set value of the programmable interval timer 274. The programmable interval timer 274 produces an end pulse when the count value reaches the set value. The end pulse is latched in a latch circuit 276 of which the output is supplied to an interrupt line 278 of the microcomputer 272 and an input line 280. The microcomputer 272 is connected to an I/O port 282. The motors 160, 164 and 166 are connected through the pulse motor driver 238 to the I/O port 282.

Figure 14:
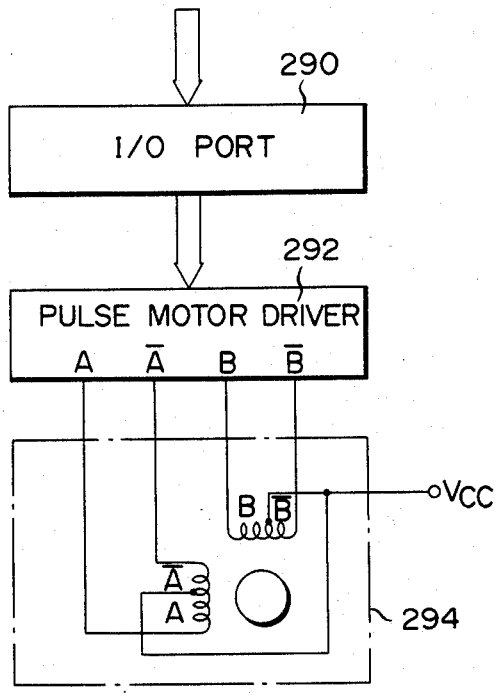
FIG. 14 is a block diagram showing a drive circuit for the pulse motor.

FIG. 14 shows the control circuit for the pulse motors. As shown, a pulse motor driver 292 (corresponding to the pulse motor drivers 236 and 238 in FIG. 10) is connected to an I/O port 290 (corresponding to the I/O ports 270 and 282 in FIGS. 12 and 13). The pulse motor driver 292 is connected to the windings A, $\bar{A}$, B and $\overline{B}$ of a pulse motor 294 (corresponding to the pulse motors 150, 152, 154, 156, 160, 164 and 166).

Figure 15:
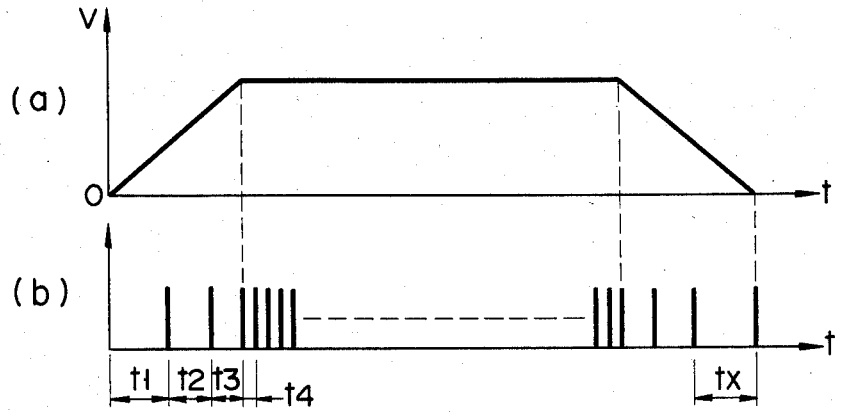
FIG. 15 shows a characteristic diagram depicting a speed control of the pulse motor.

FIG. 15 illustrates how the pulse motor's speed is controlled. FIG. 15A illustrates the speed curve of the pulse motor, and FIG. 15B illustrates the time intervals used in phase switching the motor. As seen from the graph, the time interval used in phase switching is long at the initial stage, and then gradually shortens becoming constant. Next, the time interval becomes gradually longer again, and the motor stops. In other words, the curve illustrates the so-called through-up and through-down, as it rises from the self-starting region, passes the high-speed region which is used in the motor operation for driving the related portions, and falls down. In the figure, t1, t2, . . . , tx indicate the time interval for phase switching.

The operation of a copy machine thus arranged will be described. Various copy conditions, such as the number of copies required or the size of copy sheet, are set up by the operation panel (FIG. 4). If the power is already ON, the main processor 220 judges as to whether a copy sheet is jammed or not in the transfer path using a signal from the jam detector 246. If the paper is jammed, the code for jam trouble is displayed by the copy number display 104. If a jam has not occurred the main processor 220 judges the size of the copy sheet on the basis of output from the cassette size sensors 50 and 52 and the signal from the upper or lower cassette select key 112 or 114. For example, the A4 size may be designated. As a result of this selection the main processor 220 supplies an initializing signal for the optical system to the first sub-processor 222, thereby controlling the motor 154. Specifically, the motor 154 is driven, and the first and second carriages 172 and 174 are moved. The first carriage 172 is moved up to a position equal to the width W of the selected copy sheet from the left end of the document table (FIG. 7). At this time, the main processor 220 lights the auxiliary display 206 to display the allowable range of the width on the document table 12. This enables the operator to see instantaneously as to whether or not the document falls within the allowable range. Further, the first sub-processor 222 drives the motors 150, 152, and 156 to set the lens block 34, the mirrors 28 and 30, and the shutter to an equal-magnification position. When the power is switched on, the main processor 220 also turns on the motor 168 which rotates the cooling fan 68 and turns on the heater 230. As the heater 230 reaches the fixing temperature, the operation panel 14 displays a copy ready condition. The operation up to this point is the initializing phase of the copy machine. The rest of the operating description for the copy machine will be explained in the following copy modes.

(I) One-Time Scanning/Signal-Side Copy

A single A4-size document is put on the document table 12 and is aligned with the left end of the document table 12. When the start key 100 is depressed, the exposure lamp 24 lights up and the optical system moves to the left end of the document table 12. During the movement of the optical system, light from the exposure lamp 24 increases to a specified value. When the exposure lamp 24 moves to a specified distance, i.e., the through-up distance of the motor, from the left end of the document table 12, the rotating direction of the motor 154 is reversed. Then, the optical system moves to the right to scan the document. Scanning is performed in the high speed region of the pulse motor. Synchronized with the document scanning, the photosensitive drum 36 rotates forming the electrostatic latent image of the document thereon. The electrostatic latent image attracts toner as it passes through the developer 40. As the leading edge of the toner image reaches the transfer device 48, the leading edge of the copy sheet also reaches the transfer device 48 due to the well-timed rotation of the aligning roller pair 46 driven by the pulse motor 166. In this way, the toner image is transferred to the copy sheet, is then separated from the photosensitive drum 36, and finally is fixed by the fixing roller pair 158. The copy is finally discharged outside the machine throught the discharge roller pair 60.

(II) One-Time Scanning/Double-Side Copy

In this mode, the gate 70 closes the discharge port, so that the copy sheet emanating from the discharge roller pair 60 is transferred to the inverting roller pair 72. The copy sheet reversed in its transfer direction is returned up to the aligning roller pair 46 through the transfer belts 74 and 76, and waits there for the succeeding copying operation. At this time, the copy sheet is reversed by the inverting path 78 and is fed to the aligning roller pair 46. Then, the first document is removed from the document table 12 and the second document is set thereon. The second document image is copied on the reverse side of the copy sheet through a process similar to that of the mode (I). At this time, the gate 70 retracts from the discharge port. Accordingly, the copy sheet bearing images on both sides is discharged outside the copy machine.

(III) Two-Time Scanning/Single Side Copy

Figure 16A:
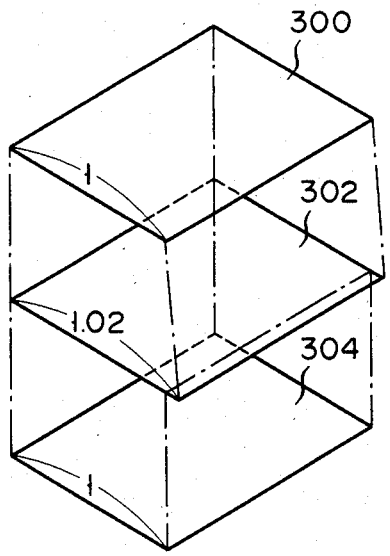
FIGS. 16A and 16B respectively illustrate the relationships between a toner image and a copied image in the operation modes of the embodiment shown in the FIG. 1.
Figure 16B:
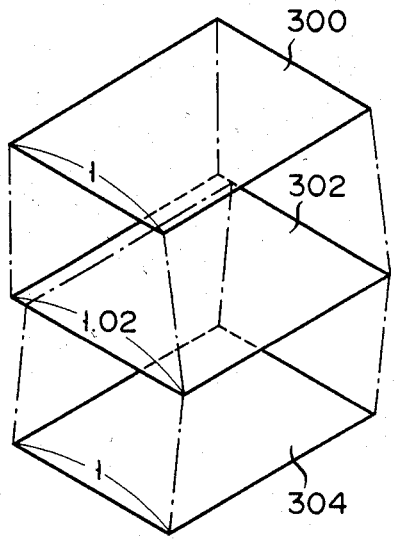

In this mode, two separate documents, or two pages of a notebook are set side-by-side on the document table 12. When the start key is pushed, the first document (left side) is scanned by the optical system as in the mode (I). However, the scanning speed of the optical system, i.e., the rotating speed of the motor 154, is 1/1.02 times that of the mode (I). The rotating speed of the photosensitive drum 36 is the same as in the mode (I). Thus, the scanning speed is slower, and the scanning distance per unit time is 1.02 times longer. The image formed on the photosensitive drum 36 is enlarged 1.02 times that of the document image as measured in the scanning direction. The operation timing of the aligning roller pair 46 is the same as in the mode (I). With this timing, the toner image corresponding to the left end of the document is transferred to the copy sheet so as to exactly align with the leading edge of the copy sheet. The width of the toner image is 1.02 times the width of the copy sheet. Therefore, the end portion of the toner image, i.e, the right end of the document, extends beyond the copy sheet. Therefore, the images at the joint line portion between the first and second documents are not copied. This is illustrated in FIG. 16A. The width of the document 300, extending in the scanning direction, is enlarged 1.02 times to provide an enlarged toner image 302. The toner image 302 is cut off at the right end portion, and copied on the copy sheet 304 with the same size as that of the document. In this way, the copy sheet bearing an image with a slightly enlarged width and lacking the right end portion of the document image is taken out of the copy machine. At this time, the optical system stays at the scanning end point of the first document. When the first copy is discharged outside the machine, the optical system is returned to the left by the through-up distance of the pulse motor, and then is moved to the right for scanning a second document. Also at this time, the scanning speed of the optical system is 1/1.02 times that of the one-time scanning mode (the modes I and II). Therefore, an image with a width 1.02 times that of the actual document is formed on the photosensitive drum 36. The operation timing of the aligning roller pair 46 is slower than the first document copying, and is controlled so that the right end of the document is exactly aligned with the trailing end of the copy sheet. Therefore, the left end of the second document, i.e., closer to the first document, is not copied, as shown in FIGS. 16B. Thus, in this mode (III), the space between the two documents is not copied. This indicates that even if the machine is operated in the two-time scanning mode, the joint portion is never copied as a black line, unlike in the prior art. If the scanning speed is reduced below 1/1.02, the copied image appears to be unnatural in the lateral direction. On the other hand, if the scanning speed is within the range between 1/1.02 and 1.00, the black stripe problem remains unsolved. Thus, eventually, it is best that the scanning speed is set not too much above or below 1/1.02.

(IV) Two-Time Scanning/Double-Side Copy

The setting of the documents and the scanning of the documents are the same as in the mode (III). The difference from the mode (III) is that the image of the second document is copied by gate 70 action on the reverse side of the copy sheet of which has on the obverse side the image of the first document.

The above description refers to the copying operation when only one copy is desired. For copying more than one copy, the above operation is simply repeated.

As described, the first carriage 172 for supporting the exposure lamp 24 and the mirror 26 in the optical system has as its home position a position equal to the width of the copy sheet from the left end of the document table 12. Further, the first carriage 172 is provided with the auxiliary display 206. The copy allowable range is visualized on the document table 12. Additionally, since the home position is at the center of the main frame, less moment is required for opening the upper unit when jam occurs.

Figure 17:
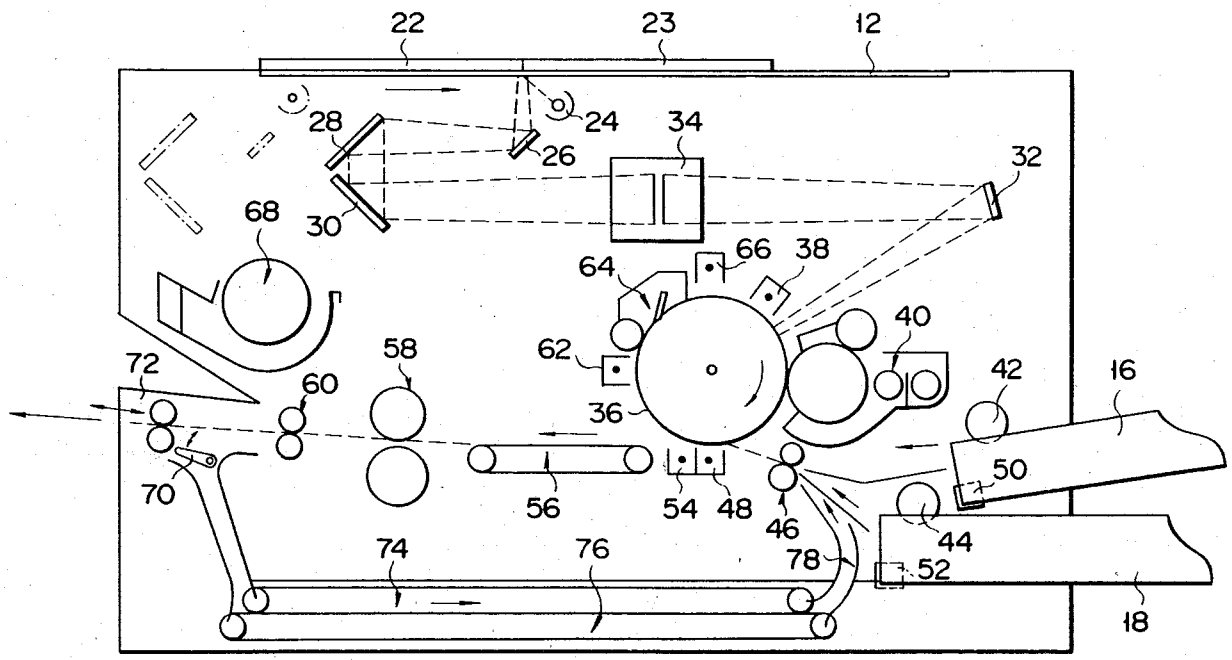
FIG. 17 illustrates in cross section a scheme of a modification of the embodiment shown in FIG. 1.

One of the modifications of the first embodiment is that the pair of inverting rollers 72 may be disposed closer to the gate 70, as shown in FIG. 17.

Figure 18:
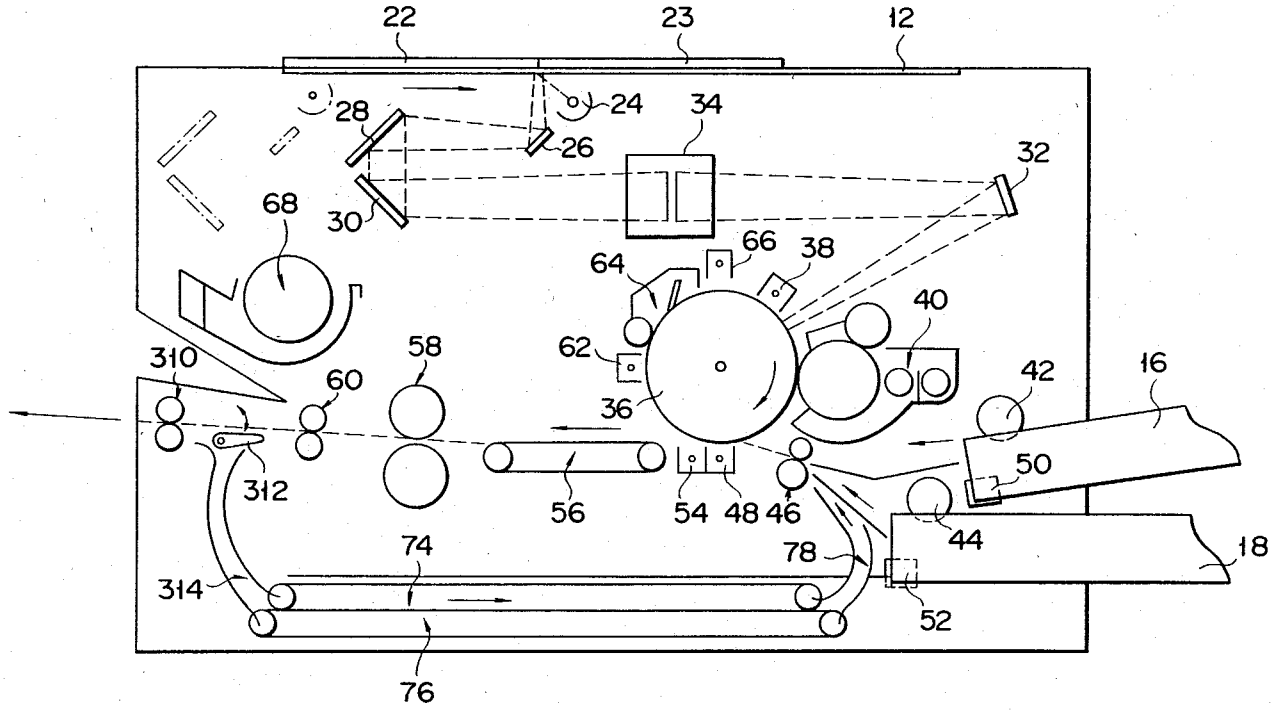
FIG. 18 illustrates in cross section a scheme of a second embodiment of a copy machine according to the present invention.

A second embodiment of a copy machine according to the present invention will now be described. The second embodiment's function does not include producing double-sided copy, rather its function is to superpose copy. Of course, the two timing scanning mode or the one time scanning mode may be selected. A cross sectional structure of the second embodiment is shown in FIG. 18. In FIG. 18, like reference numerals are used for designating the like or equivalent portions of FIG. 2 of the first embodiment. In the present embodiment, the copy is discharged from the machine, not directly through the discharge roller pair 60, but through a feed roller pair 310. A gate 312 is provided between the discharge roller pair 60 and the feed roller pair 310 which directs the copy sheet to the feed roller pair 310 or the inverting path 314. The copy sheet which was directed to the inverting path 314 is then transferred to the transfer belts 74 and 76. The copy is next sent to the aligning roller pair 46 through the inverting path 78.

Figure 19:
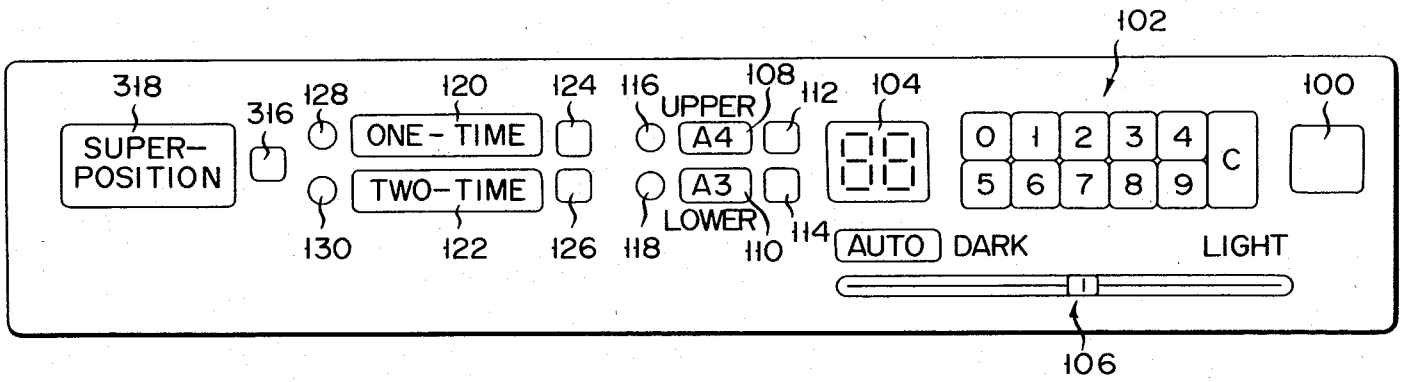
FIG. 19 shows a plan view of an operation panel of the second embodiment.

FIG. 19 is a plan view of the operation panel in the second embodiment. As shown, a superposition copy select key 316 and a display 318 for displaying the selection are provided in place of the select key for the single-side or the double-side copy mode of the first embodiment. When the superposition copy mode is not selected, the copy machine is in the normal mode (the mode I or III in the first embodiment).

The remaining arrangement of the second embodiment is substantially the same as that of the first embodiment.

The operation of the second embodiment will next be described. The operation is classified into four modes; (I) one-time scanning/normal copy, (II) one-time scanning/superposition copy, (III) two-time scanning/normal copy, (IV) two-time scanning/superposition copy.

In the modes I and III, the operation of the copy machine is the same as in the modes I and III of the first embodiment. In those modes, the gate 312 is positioned as shown in FIG. 18 so that each copied sheet is quickly discharged.

In the modes II and IV, the gate 312 blocks the transfer path to the outside of the copy machine and directs the copied sheet to the inverting path 314. The copied sheet is returned to the aligning roller pair 46 through the inverting paths 314 and 78. Note here that since the copied sheet passes through two inverting paths, the copy sheet is not inverted, unlike the first embodiment. In the mode (II), at this point, the document is replaced with another document, and the image of the second document, upon the copy starting signal, is copied on the copy sheet superposed on the already copied image of the first document. In the mode (IV), the second scanning of the second document is automatically started in order to superpose this copy. Also in the second embodiment, in the two-time scanning mode, i.e., the mode (III) or (IV) the scanning speed of the optical system is slower than that in the mode (I) or (III). Accordingly, the image at the joint portion of the two documents is not copied. The superposition copy mode may be used where one of the documents contains frames such as a table, and the other contains characters which fill the frames of the first document. In other words, the two documents are superposed to form a composite image of a table.

In both of the two embodiments, the scanning speed of the optical system is slowed down in the two-time scanning mode to only enlarge the width of the document. Alternatively, an enlarged toner image $1.02 \times 1.02$ times the document image may be formed on the drum by using a magnification changing lens block 34 with a fixed scanning speed. Also in this case, the timing of the aligning roller pair 46 for the rotation of the drum 36 is adjusted. If this modification is made, the document image is uniformly enlarged both in length and in width. By enlarging the entire document, any, deformation of the copied image in the lateral direction is removed.

In the above-mentioned embodiments, when two documents are arranged on the document table, scanning is performed for each document, because it is impossible to feed two copy sheets to the aligning roller pair 46 in a successive manner. Alternatively, if the machine is structured such that two copy sheets can be successively fed to the aligning roller pair 46 in a side-by-side fashion as the documents are arranged on the document table, a couple of documents may be scanned at one time and the latent images of the documents may be formed on the drum in a successive manner. Further, the aligning roller pair 46 is controlled to make the appropriate time lag between the two copy sheets in order to remove the joint portion of the copy sheets. In this case, setting one or two documents on the document table is not called one-time scanning or two-time scanning, rather it is called one-time copying or plural-times copying. It is possible to scan the document from right to left in FIG. 2.

As described above, the copy machine according to the present invention displays the copy allowable range in the document table.

It should be understood that the present invention may variously be changed and modified within the scope of the invention.

What is claimed is:

1. An apparatus for photocopying a document including:

means for selecting a first dimension of an image to be copied;

document table means for supporting a document bearing an image to be copied, said table means including means defining a first alignment guide;

optical scanning means, movably disposed under said document table means, for optically scanning said document to form an optical image thereof;

scanner moving means, operatively coupled to said scanning means, for moving said scanning means to an initial resting position located a distance from said first alignment guide equal to said dimension selected by said selecting means, and for thereafter moving said optical scanning means between said initial position and the position of said first alignment guide so as to optically scan said document; and second alignment guide means, disposed on said optical scanning means and visible through said document table means, for permitting said document to be aligned between the initial position of said scanning means and the position of said first alignment guide.

2. An apparatus as in claim 1 wherein said scanning means includes:

a carriage;

scanning lamp means, disposed on said carriage, for illuminating said document; and auxiliary lamp means, disposed on said carriage, for visually indicating the initial position of said scanning means.

3. An apparatus as in claim 2 wherein:

said document table means comprises a sheet of transparent material including means defining at least one translucent edge; and said auxiliary lamp means is in registry with said translucent edge at last when said scanning means is at said initial position.

4. An apparatus as in claim 2 further including means for actuating said auxiliary lamp means whenever said scanning means is at said initial position and for deactuating said auxiliary lamp means when said scanning means is moved away from said initial position.

5. An apparatus for photocopying a document including:

means for selecting first dimension of an image to be copied;

document table means for supporting a document bearing an image to be copied, said table means including means defining a first alignment guide;

optical scanning means, movably disposed under said document table means, for optically scanning said document to form an optical image thereof;

scanner moving means, operatively coupled to said scanning means, for moving said scanning means to an initial resting position located a distance from said first alignment guide equal to said dimension selected by said selecting means, and for thereafter moving said optical scanning means between said initial position and the position of said first alignment guide so as to optically scan said document, wherein said scanning means includes:

a carriage, scanning lamp means, disposed on said carriage, for illuminating said document, and auxiliary lamp means, disposed on said carriage, for visually indicating the initial position of said scanning means.

6. An apparatus as in claim 5 wherein:

said document table means comprises a sheet of transparent material including means defining at least one translucent edge; and said auxiliary lamp means is in registry with said translucent edge at least whenever said scanning means is at said initial position.

7. An apparatus as in claim 5 further including means for actuating said auxiliary lamp means whenever said scanning means is at said initial position and for deactuating said auxiliary lamp means when said scanning means is moved away from said initial position.

8. A method of photocopying a document including the steps of:

(1) selecting a first dimension of a document to be copied;

(2) moving an optical scanner movably disposed under a document table to an initial position located a distance from a first alignment guide disposed on said document table equal to said first dimension selected by said selecting step (1);

(3) resting said scanner at said initial position;

(4) disposing a document to be photocopied onto said document table between said first alignment guide and said optical scanner initial position; and (5) subsequent to said disposing step (4), optically scanning said document with said optical scanner between said initial position and the position of said first alignment guide, wherein said disposing step (4) further includes the step of aligning said document with a second alignment guide disposed on said optical scanner and visible through said document table.

9. A method as in claim 8 wherein:

said method further includes the step of illuminating a spot on said document table with an auxiliary lamp disposed on said optical scanner during said resting step (3); and said disposing step (4) further includes the step of aligning said document between said first alignment guide and said illuminated spot.

10. A method as in claim 9 wherein said illuminating step includes the step of shining light onto a translucent portion of said document table.

11. A method of photocopying a document including the steps of:

(1) selecting a first dimension of a document to be copied;

(2) moving an optical scanner movably disposed under a document table to an initial position located a distance from a first alignment guide disposed on said document table equal to said first dimension selected by said selecting step (1);

(3) resting said scanner at said initial position;

(3A) illuminating a spot on said document table with an auxiliary lamp disposed on said optical scanner during said resting step (3);

(4) disposing a document to be photocopied onto said document table between said first alignment guide and said optical scanner initial position; and (5) subsequent to said disposing step (4), optically scanning said document with said optical scanner between said initial position and the position of said first alignment guide, said disposing step (4) including the step of aligning said document between said first alignment guide and said illuminated spot.

12. A method as in claim 11 wherein said illuminating step includes the step of shining light on a translucent portion of said document table.

* * * * *